United States Patent [19]

Matsudo et al.

[11] 3,959,029

[45] May 25, 1976

[54] PROCESS OF MAKING COLD REDUCED AL-STABILIZED STEEL HAVING HIGH DRAWABILITY

[75] Inventors: Kazuo Matsudo; Takayoshi Shimomura, both of Fukuyama, Japan

[73] Assignee: Nippon Kokan Kabushiki Kaisha, Tokyo, Japan

[22] Filed: Feb. 4, 1974

[21] Appl. No.: 439,601

Related U.S. Application Data

[63] Continuation-in-part of Ser. No. 200,559, Nov. 11, 1971, abandoned.

[30] Foreign Application Priority Data

Nov. 21, 1970 Japan ..... 46-103164

[52] U.S. Cl. ..... 148/12 C; 148/12.1

[51] Int. Cl.[2] ..... C21D 9/48

[58] Field of Search ..... 148/12.1, 12 C, 12.3

[56] References Cited

UNITED STATES PATENTS

| | | | |
|---|---|---|---|
| 3,239,390 | 3/1966 | Matsukura et al. | 148/12.1 |
| 3,244,565 | 4/1966 | Mayer et al. | 148/12.1 |
| 3,248,270 | 4/1966 | Laidman et al. | 148/12 |
| 3,281,286 | 10/1966 | Shimizu et al. | 148/12.1 |
| 3,336,166 | 8/1967 | Shimizu et al. | 148/12.3 |
| 3,404,047 | 10/1968 | Goodman et al. | 148/12.1 |

*Primary Examiner*—W. Stallard
*Attorney, Agent, or Firm*—Moonray Kojima

[57] ABSTRACT

In a two stage cold reducing process, Al-stabilized steel is subjected to a decarburizing treatment as intermediate annealing between the first and second cold reducing, to impart unexpectedly high drawability to Al-stabilized steel, the drawability being more than 2.00 $\bar{r}$ (Lankford value). Such Lankford value shows that the steel is capable of sustaining any severe press forming.

8 Claims, 2 Drawing Figures

INVENTORS
KAZUO MATSUDO
TAKAYOSHI SHIMOMURA
BY Moonray Kojima, Jr.
ATTORNEY

PROCESS OF MAKING COLD REDUCED AL-STABILIZED STEEL HAVING HIGH DRAWABILITY

This application is a continuation-in-part of Ser. No. 200,559, filed Nov. 11, 1971, and now abandoned.

BACKGROUND OF INVENTION

This invention relates to an improved process for making cold reduced Al-stabilized steel, and more particularly to such a process of producing an Al-stabilized steel having high drawability and non-aging property.

High drawability and non-aging property are required for press forming operations. In the prior art, many attempts have been made to obtain improvements in both properties. None has been successful. For example, two stage cold reducing of a rimmed steel, or degassing of a Ti (Titanium) or Al (Aluminum) stabilized steel has been used.

The former steel may display high drawability in a rimmed steel, but, it also displays remarkably bad aging property. Thus, de-nitrizing process is used to avoid the aging. But, this also increases manufacturing costs, and hence, is unsuitable as an alternative.

On the other hand, the latter steels have good stability insofar as aging is concerned, but, the Ti-stabilized steel is expensive since it requires degassing and since such degassing decreases the surface quality.

The surface quality of Al-stabilized steel is superior to that of the above Ti-stabilized steel. But, the drawability of prior art Al-stabilized steel is substantially inferior to that of the rimmed steel made by a two stage cold reducing process. The problem in the prior art was thusly, to raise the drawability of Al-stabilized steel. Such an improved steel would be the best to employ in a press forming process.

Many attempts have been made to resolve this problem. None has succeeded. For example, the two stage cold reducing process previously used for rimmed steel was also employed in an attempt to improve the Al-stabilized steel. The effect produced in rimmed steel was, however, not obtained. The reason seems to be that the second cold reducing step and successive softening annealing step do not improve the drawability because precipitation of AlN has been finished at the intermediate annealing step.

Thus, it is recognized by workers in the art, that at the present state of the art, the most suitable steel for severe cold forming has not yet found.

SUMMARY OF INVENTION

This invention radically departs from the prior art and resolves the aforementioned problems. It produces a steel which is suitable for severe cold forming. In the invention, Al-stabilized steel is subjected, after a first cold working step, to decarburizing annealing as an intermediate heat treatment. The steel is then successively passed through a second cold reducing step and then a final softening annealing step. The resulting steel is capable of withstanding any press forming operation.

DETAILED DESCRIPTION OF PREFERRED EMBODIMENTS

Figure 1:
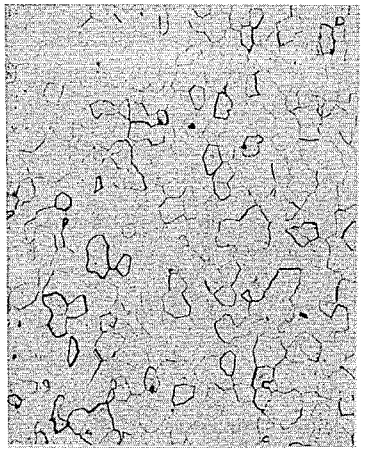
FIG. 1 is a micrograph of 100× magnification, showing ferrite structure after first cold reducing and intermediate decarburizing annealing.

Drawability of Al-stabilized steel depends upon how AlN precipitates. The precipitating effect of the AlN at recrystallized annealing stage lies in driving or accelerating preferential nuclei formation and growing of [111] plane at the same time. The drawability is improved with the above behavior of AlN. In such a case, the greater the strength of [111] plane in texture formed at cold reducing stage, and that of [100] plane is, the greater strength of [111] plane in texture after recrystallized annealing the lower that of [100] plane is.

According to our experiments, we confirmed that the above behaviour of AlN appears only at the first cold reducing and intermediate annealing stage in a two stage cold reducing process. Consequently, at the second cold reducing and final annealing stage, the strength of [111] plane decreases as that of [100] plane increases. This is the reason why a two stage cold reducing process is not effective in obtaining the desired properties in Al-stabilized steel. That is to say, while the precipitation of AlN is finished fully only at the first stage, the operation and treatment at the second stage are not requited. The second stage does not improve the drawability of Al-stabilized steel, as has been sought.

However, we have found that when the decarburizing annealing was carried out as the first annealing to decrease the carbon content less than 0.01% in the two stage cold reducing process of Al-stabilized steel, behavior which has never been seen in others took place, that is, the C content is less than about 0.01% (by weight as used herein), the less the strength of [110] plane decreases, so much the more that of [111] plane increases. This is especially so in the case of about 0.002% Carbon. The strength of other planes, excepting the [111] plane, decreases substantially, for example, that of [100] plane becomes close to zero.

Thus, the Carbon content in steel should be decarburized to less than 0.01%, preferably about 0.002% at the intermediate annealing stage. The decarburized annealing is employed in place of the ordinary recrystallizing annealing. An additional effect, excepting the texture improved with the above discussed intermediate recarburizing annealing, is to drive or control grain growth of the Al-stabilized steel. While grain sizes are controlled at the final annealing stage, the $\bar{r}$ value (Lankford value) of about 2.2 to about 2.5, which is as good as that of known two stage cold reduced rimmed steel, may be readily obtained.

Al-stabilized steel which may be used in this invention consists essentially of 0.03 to 0.15% C; 0.02 to 0.07% SolAl; and other elements, e.g. Fe, Mn, P, S, N, present in ordinary quantities as in other Al-stabilized steel. Carbon is limited to the range of 0.03 to 0.15% because less than 0.03% C is difficult to obtain with ordinary steel making processes, and more than 0.15% is difficult to decarburize at the intermediate annealing stage of this invention. Less than 0.02% Sol.Al. is impossible to attain crystal structure as an Al-stabilized steel and more than 0.07% Sol.Al. brings about undesirable precipitation of AlN at the coiling stage after hot-rolling, and unnecessary hardening.

When continuous hot rolling is used, the finishing temperature should be more than the $Ar_3$ point, and the coiling should be carried out at less than about 600°C, so that precipitation of AlN does not occur. In this case, thickness of more than 3.2mm will be desired as the finishing thickness of a hot rolled strip, because the next two stages of cold reducing may be more readily carried out depending upon the thickness.

The first cold reducing is carried out at a reduction rate of more than 30% and successively the steel is subjected to an intermediate decarburizing annealing wherein the C content in the steel is reduced to less than 0.01%, preferably to about 0.002%. The reduction rate of the second cold reducting stage is more than 30%, and preferably more than 50%. A final annealing process is carried out thereafter, using any known recrystallized softening annealing.

The cold reducing processes can be any of those known in the art, as can the annealing steps, provided, of course, that the foregoing conditions of the present invention are adhered to.

The excellent mechanical properties of this inventive steel made by the process as mentioned above, will be apparent from the actual following samples made and compared with prior art comparative steels. Comparative steel I is an ordinary Al-stabilized steel. Steel II or Steel III is a rimmed steel having different sequence of decarburizing annealing at the known two stage cold reducing processes respectively. Chemical composition of the Examples is shown in Table I. Manufacturing conditions are shown in Table II. Mechanical properties are shown in Table III.

TABLE I

| | C | Mn | P | S | N | Sol.Al. |
|---|---|---|---|---|---|---|
| 1. Inventive Steel | 0.05 (0.002) | 0.34 | 0.013 | 0.016 | 0.0046 | 0.048 |
| 2. Comparative Steel I | 0.05 (0.002) | 0.35 | 0.011 | 0.018 | 0.0047 | 0.050 |
| 3. Comparative Steel II | 0.07 (0.002) | 0.36 | 0.010 | 0.018 | 0.016 | — |
| 4. Comparative Steel III | 0.04 (0.002) | 0.30 | 0.011 | 0.017 | 0.0015 | — |
| 5. Comparative Steel IV | 0.05 | 0.34 | 0.013 | 0.016 | 0.0046 | 0.048 |
| 6. Comparative Steel V | 0.05 (0.002) | 0.34 | 0.013 | 0.016 | 0.0046 | 0.048 |
| 7. Comparative Steel VI | 0.07 (0.002) | 0.36 | 0.010 | 0.018 | 0.0016 | — |
| 8. Comparative Steel VII | 0.07 (0.002) | 0.36 | 0.010 | 0.018 | 0.0016 | — |

Note: ( ) is the value after decarburizing.

TABLE II (Manufacturing Conditions)

| | Hot rolling (°C) | | Cold Reducing (mm %) | | Annealing | |
|---|---|---|---|---|---|---|
| | Finishing Temperature | Coiling Temperature | The First | The Second | The First | The Second |
| 1. Inventive Steel | 860 | 540 | (62) 6.0→2.3 | (65) 2.3→0.8 | Decarburization 780°C | Ordinary 780°C |
| 2. Comparative Steel I | 860 | 540 | (75) 3.2→0.8 | (—) | Decarburization 780°C | (—) |
| 3. Comparative Steel II | 870 | 600 | (62) 6.0→2.3 | (65) 2.3→0.8 | Ordinary 700°C | Decarburization 780°C |
| 4. Comparative Steel III | 870 | 595 | (62) 6.0→2.3 | (65) 2.3→0.8 | Decarburization 750°C | Ordinary 780°C |
| 5. Comparative Steel IV | 860 | 540 | (62) 6.0→2.3 | (65) 2.3→0.8 | Ordinary 780°C | Ordinary 780°C |
| 6. Comparative Steel V | 860 | 540 | (62) 6.0→2.3 | (65) 2.3→0.8 | Ordinary 700°C | Decarburization 780°C |
| 7. Comparative Steel VI | 860 | 540 | (75) 3.2→0.8 | — | Ordinary 700°C | — |
| 8. Comparative Steel VII | 870 | 600 | (62) 6.0→2.3 | (65) 2.3→0.8 | Ordinary 700°C | Ordinary 700°C |

TABLE III (Mechanical Properties)

| | | Thickness (mm) | Y-P (Kg/mm²) | Y-P-El (%) | T.S. (Kg/mm²) | El. (%) | r | Aging Index Kg/mm² |
|---|---|---|---|---|---|---|---|---|
| 1. Inventive Steel | After First Operations | 2.3 | 14.1 | 0 | 28.0 | 55.5 | 1.89 | 0 |
| | After Second Operations | 0.8 | 15.3 | 0 | 28.3 | 50.8 | 2.23 | 0 |
| 2. Comparative Steel I | After First Operations | 0.8 | 15.4 | 0 | 28.1 | 49.6 | 1.99 | 0 |
| 3. Comparative Steel II | After Second Operations | 0.8 | 15.1 | 0 | 27.5 | 56.3 | 2.21 | 5.2 |
| 4. Comparative Steel III | After Second Operations | 0.8 | 17.6 | 0 | 29.2 | 52.4 | 2.38 | 5.0 |

TABLE III-continued

| | | | (Mechanical Properties) Thickness (mm) | Y-P (Kg/mm²) | Y-P-El (%) | T.S. (Kg/mm²) | El. (%) | r | Aging Index Kg/mm² |
|---|---|---|---|---|---|---|---|---|---|
| 5. | Comparative Steel IV | After First Operations | 2.3 | 18.1 | 0 | 30.2 | 49.3 | 1.61 | 0 |
| | | After Second Operations | 0.8 | 20.3 | 0 | 30.6 | 47.2 | 1.54 | 0 |
| 6. | Comparative Steel V | After First Operations | 2.3 | 18.1 | 0 | 30.2 | 49.3 | 1.61 | 0 |
| | | After Second Operations | 0.8 | 16.3 | 0 | 28.6 | 50.8 | 1.68 | 0 |
| 7. | Comparative Steel VI | After First Operations | 0.8 | 21.2 | 0 | 32.1 | 47.8 | 1.29 | 4.6 |
| 8. | Comparative Steel VII | After Second Operations | 0.8 | 20.3 | 0 | 32.0 | 47.8 | 1.75 | 4.5 |

According to the above Tables, it can be appreciated that the mechanical properties of Al-stabilized steel based on this inventive process, are far superior to those of the ordinary Al-stabilized steels (1) and as good as those of the rimmed steels (11 6, and 111). At the same time, it is apparent from the above data that where the decarburization (1 and 6) is carried out, influences are effected on said mechanical properties in the case of Al-killed steel. That is, when said decarburization is not carried out on the Al-killed steel as shown in Example 5, said properties is inferior to that of the two-stage cold reduced and not-decarburized rimmed steel as shown in Example 8, specially $\bar{r}$. And moreover, when said decarburization is carried out at the second stage as in Example 6, said properties is far lower than that of one-stage decarburized Al-killed steel as shown in Example 2. This fact shows that the above decarburization process, i.e. decarburization at after the second stage, is to no purpose. It is needless to say to be based on that said precipitation effect of AlN in said 6 is fruitless. While, in the case of the rimmed steel, said decarburization effects are displayed wherever aid decarburization may be carried out as shown in Examples 3 and 4 in comparison with Examples 7 and 8. Thus, it should be noted that there is a fundamental difference in the decarburization behaviors between Al-killed steel and rimmed steel. Such excellent mechanical properties of Al-stabilized steel have been, at the instance of the inventors, for the first time, obtained.

Figure 2:
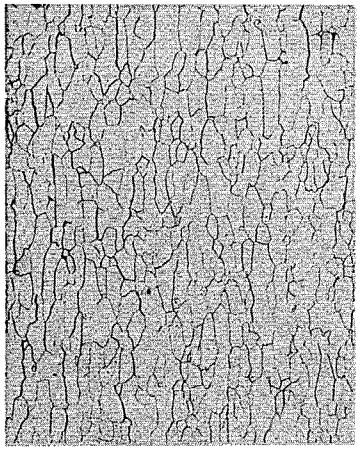
FIG. 2 is another micrograph of 100× magnification showing ferrite structure after second cold reducing and final softening annealing.

The crystal structure is as shown in FIGS. 1 and 2. FIG. 1 is a micrograph of 100× magnification showing ferrite structure after the first cold reducing step and the intermediate decarburizing annealing. FIG. 2 is a micrograph of 100× magnification showing the ferrite structure after the second cold reducing and the final recrystallized softening annealing.

The reason for the excellent $\bar{r}$ value for the resulting steel of this invention, may be apparent from the micrograph of FIG. 2. This micrograph shows good grain growth. Table IV, below, shows integrating strength of X-Ray Reflection on this inventive steel.

TABLE IV

| | | (Integrating strength of X-Ray reflection) 110 | 200 | 211 | 310 | 222 | 321 | 332 |
|---|---|---|---|---|---|---|---|---|
| Inventive Steel | After First Operations | 0.03 | 0.16 | 1.04 | 0.05 | 4.37 | 0.16 | 1.21 |
| | After Second Operations | 0 | 0.02 | 0.23 | 0.02 | 5.78 | 0.05 | 0.90 |

According to Table IV, it can be appreciated that the strength of the [111] plane after the final annealing becomes remarkably higher. The increased strength is due to the strength of other planes decreasing less.

Thus, it should be noted that the improving of drawability of Al-stabilized steel has been for the first time fulfilled by this invention, and the steel produced thereby is the best steel to use in any severe press forming operation.

The foregoing is only illustrative of the principles of this invention. Numerous modifications and variations thereof would be apparent to one skilled in the art. All such modifications and variations are to be considered within the spirit and scope of this invention.

What is claimed is:

1. Process of making Al-stabilized steel having high drawability, comprising the steps of A. making steel consisting essentially of 0.03% to 0.15% C, 0.02% to 0.07% Sol.Al., and other elements and in quantities contained in ordinary Al-Stabilized steel;

B. hot rolling said steel at a finishing temperature of more than the $Ar_3$ point, and at a coiling temperature of less than about 600°C;

C. first cold reducing said steel at a reduction rate of more than 30%;

D. first annealing said cold reduced steel at about 780°C wherein said C content is decarburized to less than about 0.01%;

E. second cold reducing said annealed steel at a reduction rate of more than 30%; and F. annealing said steel by a recrystallized softening annealing thereby to produce a steel having an $\bar{r}$ value of about 2.2 to 2.3.

2. Process of claim 1, wherein said carbon content is decarburized to about 0.002%.

3. Process of claim 1, wherein said second cold reducing is at a reduction rate of more than 50%.

4. Process of claim 1, wherein the thickness after the hot rolling, of said steel is about more than 3.2 mm.

5. Process of improving Al-stabilized steel comprising 0.03% to 0.15% Carbon and 0.02% to 0.07% Sol.Aluminum, wherein after hot rolling and cold reducing to more than 30%, the starting steel is decarbonized at about 780°C to contain less than 0.01% carbon, and subsequently cold reducing said steel to more than 30% and subjecting said steel to further annealing.

6. Process of claim 5, wherein said carbon content is reduced in the decarburizing step to about 0.002%.

7. Process of claim 5, wherein the final annealing is a recrystallized softening annealing, thereby producing steel having an $\bar{r}$ value of about 2.2 to about 2.3.

8. Process of claim 5, wherein said second cold reducing is at a reduction rate of more than 50%.

* * * * *